United States Patent [19]

Scott

[11] 4,007,717

[45] Feb. 15, 1977

[54] GOVERNOR FOR TWO-CYCLE ENGINES

[75] Inventor: William A. Scott, Cass City, Mich.

[73] Assignee: Walbro Corporation, Cass City, Mich.

[22] Filed: May 23, 1975

[21] Appl. No.: 580,425

[52] U.S. Cl. ..... 123/103 R; 123/103 B

[51] Int. Cl.[2] ..... F02D 11/08

[58] Field of Search ..... 123/103 R, 103 B, 97 R, 123/123, 129, 109; 261/DIG. 68

[56] References Cited

UNITED STATES PATENTS

| | | | |
|---|---|---|---|
| 2,297,897 | 10/1942 | Kissel et al. | 123/103 R |
| 3,092,090 | 6/1963 | Berninger | 123/103 R |
| 3,575,149 | 4/1971 | Graham | 123/103 R |

FOREIGN PATENTS OR APPLICATIONS

| | | | |
|---|---|---|---|
| 1,286,330 | 2/1969 | Germany | 261/DIG. 68 |

*Primary Examiner*—Wendell E. Burns
*Assistant Examiner*—William Randolph
*Attorney, Agent, or Firm*—Barnes, Kisselle, Raisch & Choate

[57] ABSTRACT

A speed regulator for internal combustion engines utilizing a diaphragm carburetor and utilizing pressure developed in the fan housing of the engine to act on the diaphragm to regulate the fuel supply at high speeds with the option of utilization of vacuum in the carburetor to influence the fan pressure to control the fuel mixture during high speed phase.

3 Claims, 3 Drawing Figures

FIG. 1
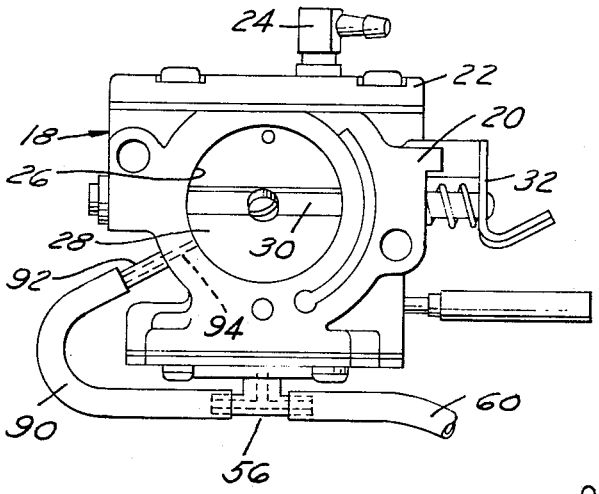
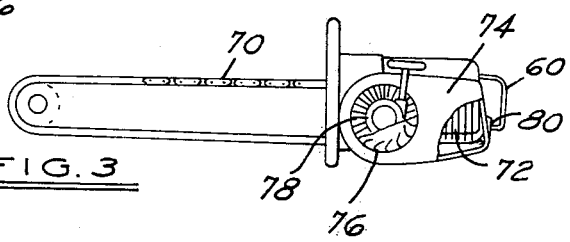
FIG. 3
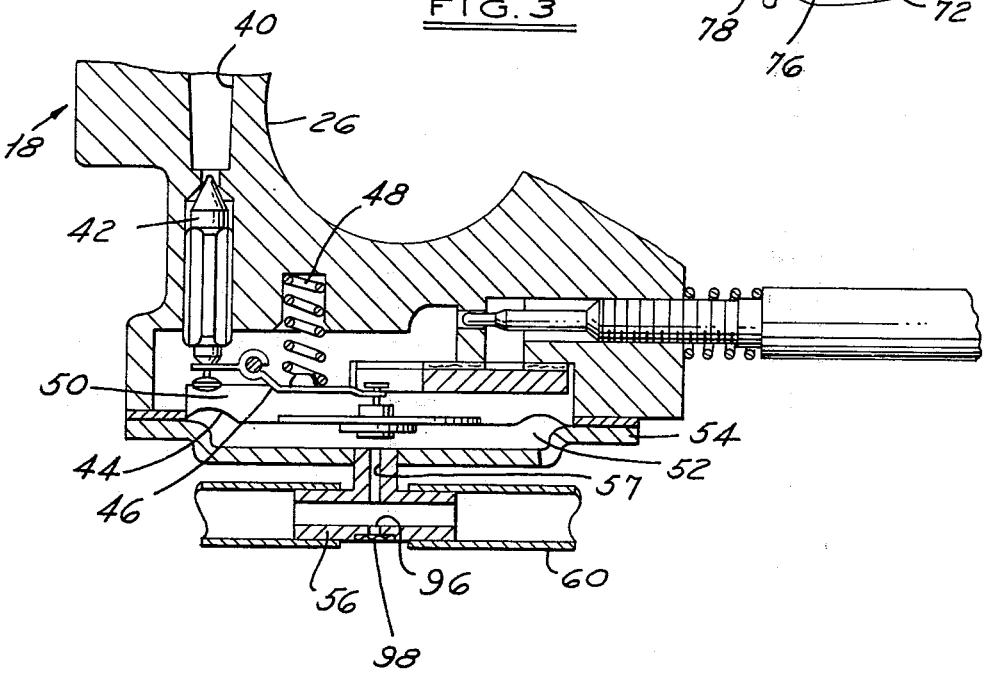
FIG. 2

GOVERNOR FOR TWO-CYCLE ENGINES

This invention relates to a Governor for Two-Cycle Engines and more particularly to a system and apparatus for controlling the speed and the fuel mixture of an engine.

Small two-cycle engines are currently commonly used for chain saws and other small appliances. Normally, where space permits, such as on a power mower, it is possible to have a mechanical speed governor to control the top speed of an engine. Without such a control, where a fixed jet size is utilized, the engine will "run away" that is, keep climbing up in speed until it self destructs because of excessive G forces and vibration.

On a small installation, such as a chain saw, the space limitations prevent the use of a mechanical governor and it is necessary to provide a top speed control by what is called a very rich fuel mixture. This causes the engine, under no-load conditions, to slow down because it shifts to what is called a "four-cycle" phase in that, due to the rich mixture, it does not fire with the two-cycle frequency but only half as often. When the engine is operating in a straight two-cycle condition, it is said to be running clean.

Thus, the object is to obtain operation which will not cause "run-away" speeds but which, under load, will run clean.

Also, in some engines, there is a "rich comedown" condition. This means that when the throttle is cut back so that the speed is reducing to idle speeds, there is a rich mixture of gasoline and air. If this becomes overrich, it can cause stalling which obviously is objectionable. Thus, any corrective measures to control top speed and to control fuel mixture under load must be such that they do not cause an overrich comedown.

It is, therefore, an object of the present invention to provide a fuel mixture control system which prevents run-away speeds, which provide a "clean" running engine at full throttle and under load, and which has a comedown phase which is not overrich.

Briefly, this is accomplished by utilizing the pressure within the engine housing, created by a cooling fan, to influence the diaphragm of the concomitant carburetor to achieve the desired fuel mixtures under the varying conditions of operation. In some instances, this may be tempered by the influence of the vacuum within the manifold or downstream the throttle valve to achieve the balance desired. Thus, by utilizing the vacuum downstream of the throttle during the time the throttle valve is shut during deacceleration from high speed to low speed, the vacuum influence to the diaphragm may be used to regulate underrun (comedown) condition.

Other objects and features of the invention will be apparent in the following description and claims in which there is set forth the principles of operation, together with the utility in connection with the best mode presently contemplated for the practice of the invention.

Drawings accompany the disclosure and the various views thereof may be briefly described as:

FIG. 1, an outside view of a carburetor to be utilized with the invention.

FIG. 2, a sectional view of the carburetor showing details of functional connections.

FIG. 3, a view of a chain saw and fan and engine housing.

With reference to the drawings in FIG. 1, a carburetor body 18 is shown having a mounting face 20 which will face against an engine housing or manifold. A fuel pump housing 22 is positioned atop the carburetor body having a connection 24 for a pulse tube from the crankcase of the engine. This pump may also be activated by internal pulse means. A mixing or venturi passage 26 is viewed from the engine side in FIG. 1 and the throttle valve 28 is shown in this passage pivoted on a shaft 30 controlled by a side lever 32. A carburetor of the general nature to be utilized with the present invention is shown in U.S. Pat. Nos. 3,743,253 and 3,743,254, issued July 3, 1974.

In FIG. 2, a sectional view shows a fuel inlet passage 40 controlled by a fuel inlet valve 42, the position of which is determined by the fluctuations of a diaphragm 44 acting on a lever 46 biased by a spring 48. The top of the diaphragm 44 is called the "wet side" in contact with fuel in chamber 50. The inverse side is termed the dry side exposed to the chamber 52.

The diaphragm 44 is held in place by a plate 54 which has a central opening in which a T-connector 56 is secured. The root of the T is open through passage 57 to the dry side of the diaphragm. The right-hand branch of the T is connected to a tube 60 which is carried around to the end of an engine housing at a point where a predetermined pressure may be obtained.

In FIG. 3 is illustrated a chain saw 70 which has an engine 72 and the illustrated carburetor confined within an engine housing or shroud 74. The engine has a fan rotor 76 rotating within the shroud inside an air inlet guard 78. The fan rotor is provided to pass coolant air over the engine. This rotor builds up pressure within the shroud and, of course, the greater the speed of the engine, the higher the pressure. Thus, the tube 60 is brought into the housing at 80 and exposed to the pressure within the housing and this pressure is reflected to the root passage 57 and the dry side of the diaphragm.

Pressure on the dry side of the diaphragm in general causes more solid fuel to reach the carburetor mixing passage and the engine, thus enriching the mixture. Thus, the higher the speed of the engine, the richer the mixture and this will prevent overrun of the engine. This is due to the fact that the rich mixture caused by the pressure underneath the diaphragm will cause the engine to "four cycle" and the speed will be limited.

On the other hand, when the throttle is wide open and the saw is cutting, the speed will, of course, be reduced and thus the fan pressure will be cut down so the fuel supply is reasonably normal. Thus, the engine will run "clean," that is, at best power efficiency.

When the throttle is suddenly cut back, the speed reduces rapidly and thus the pressure in line 60 reduces commensurately. Accordingly, an engine and carburetor that has a lean "comedown" characteristic will lose speed rapidly and settle into an "idle" speed.

If, however, a particular engine and carburetor has a "rich comedown" characteristic, then the fan pressure bias may need a moderation since the engine may underrun and stall out. This moderation is accomplished by connection to the left-hand branch of the T-connector 56 of one end of a tube 90, the other end connecting to a nipple 92 with a lead-in passage 94 to the mixing passage 26 between the throttle valve 28 and the engine. Thus, when the throttle is closed, a rather high vacuum develops in tube 90 to counteract the pressure in tube 60.

A calibration port 96 covered by a screen 98 is provided to regulate the impact of the high vacuum created by the closing of the throttle valve.

It will thus be seen that the invention results in a very simple but effective regulation of the no-load speed of an engine without affecting the efficiency of operation during a load condition. In addition, the system is adaptable in a very simple manner to a rich comedown engine which reduces the effect of pressure on the fuel diaphragm.

What I claim is:

1. In combination, a. an internal combustion engine having a housing and a cooling fan rotor in said housing, b. a diaphragm carburetor arranged to furnish a fuel and air mixture to said engine having a diaphragm chamber on one side closed by a retaining plate on the dry side of said diaphragm, c. a connector in said plate leading to the outside, d. means connecting said connector to the inside of said engine housing to transmit pneumatic pressure developed by said fan rotor in said housing to said diaphragm, e. said carburetor being mounted adjacent said engine and having a mixing passage and a throttle valve in said mixing passage, and f. means connecting said plate connector to said mixing passage between said throttle and said engine to permit the reduced pressure on said mixing passage created by the closing of the throttle valve to counteract the pressure of said engine fan rotor.

2. An engine governor control which comprises:

a. an internal combustion engine having a housing and a cooling fan rotor in said housing, b. a liquid fuel diaphragm carburetor which includes a mixing passage, a fuel inlet, a valve controlling said inlet, and a diaphragm mechanically associated with said valve and subject on one side to pneumatic fluctuations in said mixing passage to control the opening and closing of said valve, said one side of said diaphragm being a fuel side to receive fuel from said valve, and the other side of said diaphragm being a dry side unexposed to fuel, c. means forming a passage to the dry side of the diaphragm, and d. means connecting said passage to the interior of said engine housing to transmit pneumatic pressure developed within said housing by said fan rotor to the dry side of said diaphragm to prevent overrun of the engine.

3. In combination, a. an internal combustion engine having a housing and a cooling fan rotor in said housing, b. a diaphragm carburetor having a diaphragm with a wet side and a dry side, c. means forming a passage to the dry side of the diaphragm, d. means connecting said passage to the interior of said engine housing to transmit pressure developed by said fan rotor in said housing to said diaphragm, e. the carburetor being mounted adjacent the engine and having a mixing passage and a throttle valve in said mixing passage, and f. means connecting the portion of said mixing passage between said throttle valve and said engine to the dry side of said diaphragm to permit the vacuum created by the closing of said throttle valve to counteract the pressure of said engine fan rotor.

* * * * *